US006481717B1

(12) United States Patent
Richardelle

(10) Patent No.: US 6,481,717 B1
(45) Date of Patent: Nov. 19, 2002

(54) METHOD OF PLAYING A CARD GAME

(75) Inventor: James J. Richardelle, Long Beach, MS (US)

(73) Assignee: Iroc Worldwide Gaming, Inc., Long Beach, MS (US)

( * ) Notice: Subject to any disclaimer, the term of this patent is extended or adjusted under 35 U.S.C. 154(b) by 0 days.

(21) Appl. No.: 09/489,962

(22) Filed: Jan. 24, 2000

(51) Int. Cl.[7] ..... A63F 1/00
(52) U.S. Cl. ..... 273/292; 273/274
(58) Field of Search ..... 273/274, 292, 273/309; 463/13, 12

(56) References Cited

U.S. PATENT DOCUMENTS 5,248,142 A * 9/1993 Breeding
5,265,882 A * 11/1993 Malek
5,322,295 A * 6/1994 Cabot
5,328,189 A * 7/1994 Malek
5,395,120 A * 3/1995 Mlek
5,417,430 A * 5/1995 Breeding
5,639,092 A * 6/1997 Macaisa
5,851,011 A * 12/1998 Lott
5,873,571 A * 2/1999 Vaisman
5,988,643 A * 11/1999 Awada

* cited by examiner

*Primary Examiner*—Benjamin H. Layno
*Assistant Examiner*—V K Mendiratta
(74) *Attorney, Agent, or Firm*—Venable; James R. Burdett

(57) ABSTRACT

A method of playing a card game is made up of steps dealing a first hand consisting of a first predetermined number of cards, requiring one or more players to each elect whether or not to play a second hand, comparing each of the first hands to determine whether or not they constitute a winning hand, dealing a second hand consisting of a second predetermined number of cards and including the first hand, comparing each of the second hands using a predetermined ranking as a criterion for comparison to determine a winning hand, and designating as a winner each player who had a winning first hand and/or a winning second hand. The first predetermined number of cards consists of two cards, and the first hand is played as a Blackjack hand. The second predetermined number of cards consists of a number of cards, in addition to the cards drawn by each player for the Blackjack hand, to make up a poker hand. Each player is required to place a bet before each step of dealing the first and second hands, and they are paid after the step of designating winning players. Such step of paying the winning player(s) includes the step of paying the winning player according to the odds set forth in a predetermined table depending upon the poker rank of the winning hand(s).

19 Claims, 2 Drawing Sheets

METHOD OF PLAYING A CARD GAME

CROSS-REFERENCE TO RELATED APPLICATIONS

This patent application is related to U.S. Ser. No. 29/108,484 for a "Gaming Table Covering", U.S. Ser. No. 29/108,485, for a "Gaming Table Covering", and U.S. Ser. No. 09/489,961 for a "Convertible Gaming Table", each of which is commonly assigned to the assignee of the present invention, and incorporated herein by reference.

BACKGROUND OF THE INVENTION

1. Field of the Invention

The present invention relates generally to casino games, and more particularly to a method of playing a casino card game.

2. Statement of the Prior Art

The legal gaming industry has enjoyed extraordinary growth both in the United States and abroad. It has been estimated, for example, that from 1982 to 1996 the domestic gaming industry experienced a compound annual growth rate of 11.2%, to $47.6 billion in revenues. Moreover, the percentage of households from which someone visited a casino to gamble increased from 17% in 1990 to 32% in 1996, representing over 36 million households and 176 million visits, according to Harrah's 1997 Survey of Casino Entertainment.

This increase in gaming demand results in part from the greater public acceptance of legal casino gaming. For example, research conducted by Yankelovich Partners, Inc. in 1996 found that 92% of U.S. adults view casino gambling as an acceptable form of entertainment for themselves and others. This acceptance is reflected not only by the dramatic number of domestic jurisdictions in which casino gaming under one form or the other is now permitted, but also by the many foreign jurisdictions which have either legalized casino gaming or expanded it in scope in the recent past. Significant foreign gaming jurisdictions now include Canada, Australia, New Zealand, France, The Netherlands, and various South American, Asian and Eastern European nations.

The growth of legal gaming has at the same time resulted in a huge increase in the number of gaming machines, among them a host of video poker and other games as well as more traditional slot machines. Gaming machines are now by far the most popular form of gambling. At the major Nevada and New Jersey casinos, for example, they account for approximately two-thirds of total gaming revenues. Such gaming machines, along with traditional casino table games (e.g., Craps or Blackjack), can be more accurately controlled with the help of technologically innovative products and systems.

Accordingly, a first object of the present invention is to provide unique improvements to existing casino table games that will instill further growth in the legal gaming industry.

As a leisure time activity, poker and other card games have fascinated the public for years. A deck of cards, a playing surface and a few participants are all that is needed to provide a recreational few hours away from the stress and strain of daily life. Five or seven card poker is a game that almost everyone knows how to play and many games have been developed using the same basic priority or rank order of winning poker hands: Royal Flush, Straight Flush, Four of a Kind, Full House, Flush, Straight, Three of a Kind, Two Pair, One Pair and High card(s) in Hand.

For one reason or another, it has been difficult to adapt the rules of poker into a casino table game in which each player plays against the house. In a conventional poker game, a plurality of players are each dealt a poker hand by one player who acts as the dealer. The player with the highest hand based on the established priority of poker hands wins. Each player in turn deals a hand as the game continues. It is not unknown to introduce wagering into the game, generally through the use of tokens or poker chips, which may or may not have a monetary value.

Many places, as noted above, have legalized gaming and poker is one of the games of chance that is offered in both casinos and cardrooms. In a conventional cardroom poker game, the house provides a dealer, the playing cards, the table and chairs but does not play a hand. The house collects a nominal percentage of each player's bet (the "rake") which compensates the house for providing the facilities to the players. Alternatively, the house may charge each player a set amount per hand or for a specified length of time, say one-half hour. Each player is competing not against the house, but against all the other players with the highest hand winning the total of all the wagers made on that hand.

Many people do not like to play cardroom poker because each player is competing against his fellow players, not against the house. Many people would rather attempt to win money from an impersonal source, the house or the casino, rather than from their fellow players with whom they may be acquainted.

Accordingly, it,is a second object of the present invention to provide a cardroom like poker game which is played against the house in legalized gaming establishments.

Cardroom poker also does not offer any bonus payments for particularly good hands. While a Royal Flush is a rare occurrence and generates a thrill for any poker player, the player collects the same total wager that he would have collected if all he needed to beat the other players was Three of a Kind.

Another conventional form of live table poker is known as "Caribbean Stud™". Caribbean Stud is a fast-paced, exciting game on its own. However, casino operators have found that adding the dimension of progressive jackpot payoffs creates further excitement and provides an additional incentive to play. Many slot and video poker players shun live gaming because rules are complicated or the games require too much concentration. Conversely, Caribbean Stud does away with much of that. Five cards are dealt face down to each player. The dealer gets four cards down and the last card up. If a player thinks his or her hand can beat the dealer, another wager in addition to the ante bet is made. Winning players are paid for their call wager.

Accordingly, it is a third object of the present invention to provide a method of playing a card game which involves one or more players and easy-to-understand rules, and can be played in legalized gaming establishments, against the house.

Each player can make a progressive side bet in Caribbean Stud, in addition to the regular ante, prior to the start of each game. For example, various means and methods for playing Caribbean Stud are disclosed in U.S. Pat. No. 4,836,553 (Suttle et al.), U.S. Pat. No. 4,861,041 (Jones et al.), U.S. Pat. No. 5,078,405 (Jones et al.), U.S. Pat. No. 5,364,104 (Jones et al.), U.S. Pat. No. 5,377,973 (Jones et al.), U.S. Pat. No. 5,554,893 (Jones et al.), U.S. Pat. No. 5,626,341 (Jones et al.), and U.S. Pat. No. 5,725,216 (Jones), each of which is incorporated herein by reference. Other forms of progressive jackpots are disclosed in U.S. Pat. No. 5,288,077

(Jones), U.S. Pat. Nos. 5,364,105, 5,577,731 (Jones), U.S. Pat. No. 5,584,485 (Jones et al.), U.S. Pat. No. 5,655,961 (Acres et al.), U.S. Pat. No. 5,702,304 (Acres et al.), U.S. Pat. No. 5,741,183 (Acres et al.), and U.S. Pat. No. 5,752,882 (Acres et al.), each of which is also incorporated herein by reference.

If a player stays in the hand after the deal and has a flush, full house, four of a kind, straight flush or royal flush, he or she wins all or part of the progressive. Even if the dealer beats the hand, the player can still win progressive cash. Like conventional SafeJack™ tables distributed by Mikohn Gaming Corporation, Las Vegas, Nevada, monitored Caribbean Stud tables such as the Mikohn Caribbean Stud table can be equipped with an articulate dealer control panel that handles all aspects of the progressive game. Hard meter and security key functions are built right into the panel. Moreover, up to 256 tables can be linked to such progressive systems for gigantic progressive payouts. As easy as they may seem, Caribbean Stud casino card games of the likes described herein above, nevertheless, require the adoption of new sets of rules which may be unfamiliar to players of all levels of experience.

Accordingly, it is a fourth object of the present invention to provide a method of playing a card game which is fast-paced, potentially lucrative, and takes advantage of otherwise well known, easy-to-understand rules.

SUMMARY OF THE INVENTION

A method of playing a card game according to a first embodiment of the present invention comprises the general steps of dealing a first hand, consisting of a first predetermined number of cards, to one or more players, requiring each of the one or more players to elect whether or not to play a second hand, comparing each of the first hands to determine whether or not they constitute a winning hand; dealing a second hand consisting of a second predetermined number of cards, comparing each of the second hands using a predetermined ranking as a criterion for comparison to determine a winning hand, and designating as a winner each player who had a winning first hand and/or a winning seconds hand. The first predetermined number of cards preferably consists of two cards and the first hand, thus, constitutes a Blackjack hand. The second predetermined number of cards preferably consists. of a number of cards, in addition to the cards drawn by each player for the Blackjack hand, to make, up a poker hand. Each player is required to place a bet before each step of dealing the first and second hands, and they are paid after the step of designating winning players. Such step of paying the winning player(s) includes the step of paying the winning player according to the odds set forth in a predetermined table depending upon the poker rank of the winning hand(s).

According to a second embodiment of the present invention, a subsequent side bet may be placed on a progressive jackpot by those players electing to play the second hand in addition to the first hand. Winning such progressive jackpot or losing their side bets preferably depends on a predetermined ranking of the poker hands dealt.

The above and other objects, advantages, and novel features according to the present invention will become more apparent from the following detailed description thereof, when considered in conjunction with the accompanying drawings wherein:

DETAILED DESCRIPTION OF THE INVENTION

Figure 1:
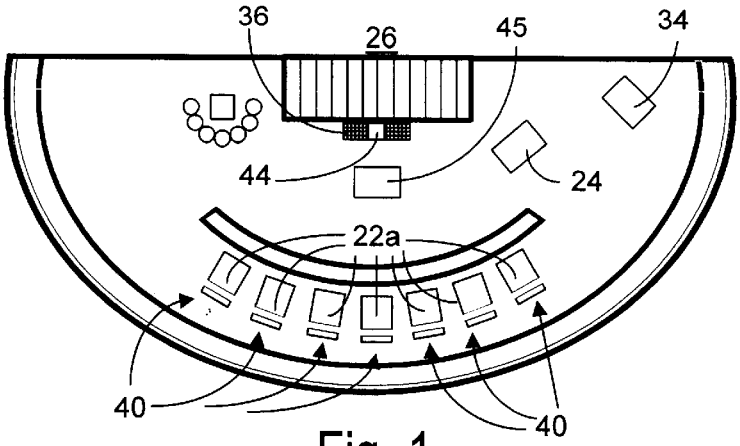
Fig. 1 PRIOR ART
FIG. 1 illustrates a top plan view of a conventional gaming table upon which can be played a card game according to the present invention.

Referring now to the drawings, wherein like or corresponding parts are designated by the same or similar reference number throughout the several views, there is shown in FIG. 1 a top plan view of a conventional gaming table 10 which may be used to play the novel card game according to the present invention. While one suitable such gaming table is distributed by Mikohn Gaming Corporation, Las Vegas, Nev., other forms of casino gaming tables, including unmonitored casino gaming tables and those monitored gaming tables manufacture and/or distributed by other sources are within the scope of the present invention. Furthermore, the method of playing a card game according to the present invention is equally applicable to convertible gaming tables of the like disclosed in the aforementioned U.S. Ser. No. 09/489,961 for a "Convertible Gaming Table" which is co-pending, commonly assigned to the assignee of the present invention, and incorporated herein by reference. While the particular design of the game table covering shown therein is also the subject of a co-pending, commonly assigned design patent application, U.S. Ser. No. 29/108,484, it should be noted that any other game table covering (e.g., the game table covering shown in co-pending, commonly assigned design patent application, U.S. Ser. No. 29/108,485) having a particular ornamental appearance will fall within the scope of the present invention as long as it incorporates the functional aspects described herein below.

The particular manner and methods of operating gaming table 10 is thoroughly discussed in the aforementioned U.S. Ser. No. 09/489,961 for a "Convertible Gaming Table". Accordingly, the following description relates more specifically only to the method of playing the novel card game according to the present invention.

Figure 2:
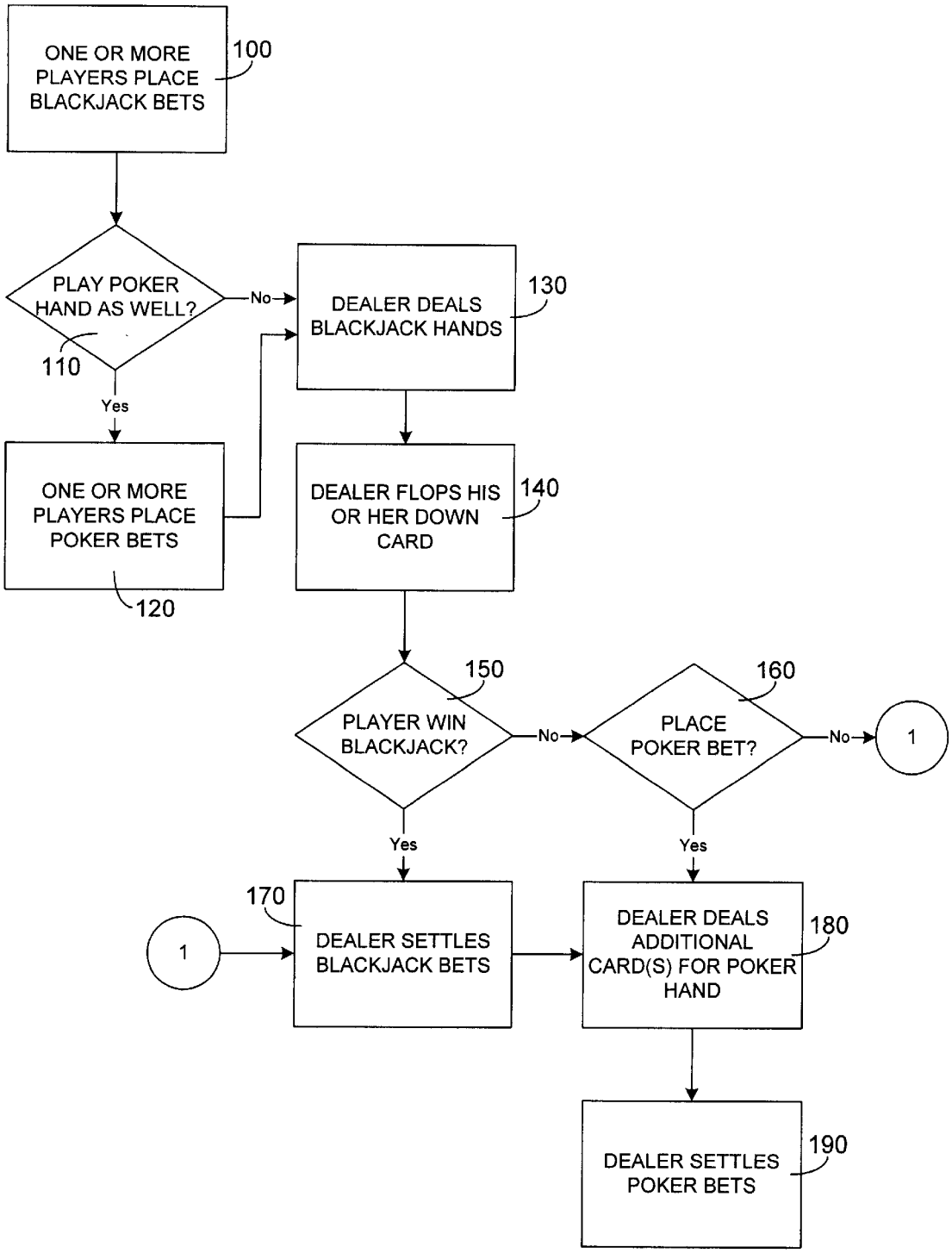
FIG. 2 is a flow chart illustrating a method of playing the card game according to one embodiment of the present invention.

With reference now to FIG. 2, the manner of play of one embodiment of the card game herein will now be described. One or more players sitting or standing in respective player positions about the arcuate outer edge of gaming table 10 place their initial bets at locations 22*a* in accordance with step 100. The amount of such bets is controlled by "house rules" and applicable gaming laws and regulations, and does not otherwise affect play of the instant card game. However, by placing their bets at step 100, a player thereby indicates his or her willingness to play a conventional casino card game of Blackjack.

As is well known, Blackjack in casinos is played with from one to eight fifty-two card decks dealt from a shoe 24 at the left of a dealer's position 26. After each game has been played, the used cards are typically disposed. All face cards are worth ten. Aces are worth either one or eleven points. However, if counting the ace as eleven would put the hand over twenty-one, it is automatically counted as one instead. All other cards are worth their face value. While the particular suits of a player's cards are most often irrelevant, the simplest way to get exactly twenty-one is to hold an ace and either a face card or a ten.

Each player antes up (e.g., by placing a $5.00 bet to play Blackjack. The dealer deals one card face down to each player and himself or herself in rotation, followed by one card face up. Each player then looks at the cards dealt to him or her, and may place a wager in addition to his or her ante (e.g., "double down", "split", or "insurance" as described herein below). If the dealer's own two cards are a so-called natural, that is, an ace and a picture or ten, he turns them over and each player pays double the amount wagered, except that the holder of another natural pays only the original bet. Should some other player draw a natural when the dealer does not, the latter pays double.

If no natural shows up after two cards have been dealt, the dealer works to each player, one at a time in rotation, dealing the cards singly until the player calls a halt. Should the player's total count exceed twenty-one he or she immediately loses. If he or she stops at or under twenty-one, the dealer turns to the next player and proceeds as described. When all the players have been dealt to, the dealer turns up his or her face down card and draws until he or she goes over twenty-one or decides to stand. If the dealer makes twenty-one, he or she collects from all the players. If over, the dealer must pay all those players who stood. If the dealer stands with less, he or she collects from those with lower counts and pays those still in the game with higher counts.

Players may take "splits" at their option. That is, if their first two cards are a pair, they may request that each be dealt to as a separate hand and wagered on as such. Bonuses may be played, with players receiving, for example, double their bets for hitting or staying under twenty-one on five cards, four times their bets for doing so on six cards, and double again for each additional card. Making twenty-one with three sevens may also collect double. Rules often vary, but are established by the so-called house rules.

Most common house rules are set forth in an arc-shaped area 28 on the upper surface 22 of the table base 12. Money wagered by the players is deposited by the dealer in a slot 30 in exchange for chips of varying denominations kept in a chip well 32.

If a player and the dealer tie, however, the hand is considered a "push" and no money will be exchanged. Players have other wagering options. For example, after "doubling" or "doubling down", a player is dealt exactly one more card, up or down, and then his or her turn ends. The player's bet, of course, is doubled. When using this option, a player is betting more money that he or she will get a good score with just one more card added to his or her starting two. A player may also take "Insurance" whenever the dealer's up-card is an ace. If the player believes that the dealer's down-card is a ten-ranking card, then the player is permitted to place a side bet, typically of up to half his or her original wager as insurance. If the dealer does have a ten-ranking card, the player is immediately paid 2-to-1 on the insurance bet, but the original wager is lost unless the player too has Blackjack and tie the dealer. Here, the player is not insuring anything, but simply betting that the dealer's unseen card is a ten-ranking card. If the dealer does not have a natural twenty-one, the rest of the hand is played out as usual and a player taking Insurance will lose his or her insurance money.

If, on the other hand, gaming table 10 is of the monitored type as noted above, the instant card game may also be played on such monitored tables. Conventional monitoring of a Blackjack game (e.g., with a SafeJack™ system distributed by Mikohn Gaming Corporation) works as follows. All chips used with such monitored gaming tables are of the "SafeChip™" variety, and are manufactured by Bourgogne & Grasset, a French manufacturer of casino chips. Each SafeChip™ includes a HITAG™ tag which is encrypted and encoded with the chip's denomination and a unique code. In such a manner, the HITAGTM tag adapts the chip to transmit its authenticity and value. It can also provide exact player handle, interfaces to existing casino management systems, and covers most casino table games, such as Baccarat, Big Six, Caribbean Stud™, Let It Ride™, Pai Gow, Roulette, Spanish 21™, Casino War™, and others.

When a player positions his or her chips in a corresponding bet area 22*a,* the SafeChips are recognized and the value of the player's stake stored. More than one SafeChip can be identified and read simultaneously, even if they are piled up on top of one another inside the bet area 22*a.* In addition, the shoe 24 identifies and records each card and where dealt. Every game is, accordingly, completely accountable and traceable.

There are several advantages with such monitored gaming tables. Resistance to forgery and fraud, as well as capture of statistical data, can be accomplished with systems such as SafeJack. It is, therefore, a further important aspect of the present invention to work seamlessly with monitored gaming tables such as a SafeJack table.

Moreover, bonus systems of various types are currently being used with monitored gaming tables. "Progressive Blackjack", for example, is dealt exactly the same as a Blackjack game in the manner described above. Separate jackpots are determined by the first, second, third, or fourth cards dealt to a player. Players optionally make a progressive side bet, in addition to their regular bet, prior to the start of the game, and can win a progressive jackpot if they are dealt one of the various combinations of aces with their first two, three, or four cards (i.e., two unsuited aces, two suited aces, three unsuited aces, three suited aces, and four red or four black aces). Even if the dealer beats their hand, a participating player can win a progressive bonus. A colorful LED display 34 on the monitored gaming table 10 keeps the players aware of the ever increasing jackpot size in real-time.

A dealer keypad 36 provided on monitored gaming table 10 facilitates the dealer's handling of all aspects of the progressive game. Hard meter and security key functions are built into the keypad 36, which also provides a record of buy-ins, enables tournament play, and addresses non-standard play. Accordingly, keypad 36 can be used as the aforementioned first selecting means to select operation of the convertible gaming table 10 between a first monitoring means and a second monitoring means. In addition to the LED display 34 on monitored gaming table 10, a controller 38 (FIG. 5) associated with such monitored gaming table 10 can be used to direct the display of the progressive jackpot information to large overhead, animated, displays (not shown). Moreover, a plurality of monitored gaming tables 10 can be linked to the system, in pit-to-pit and floor-to-floor fashion, for increased progressive payouts. See also monitoring systems disclosed in the aforementioned Acres et al., U.S. Pat. Nos. 5,655,961, 5,702,304, 5,741,183, and 5,752,882.

In any event, and referring again to FIG. 2, the players place their initial Blackjack bets at step 100. The dealer then determines whether the players want to play poker as well at step 110. Such player(s) electing to do so place a poker bet (e.g., $5.00 more to play poker in addition to Blackjack) at step 120. The, the dealer deals all player(s) a Blackjack hand at step 110 in the manner described above. If a player desires to play a poker hand in addition to his or her Blackjack hand, the player makes a decision at step 120. In the event no player elects to do so, the dealer flops his or her down card at step 140. On the other hand, if a player does elect to play a poker hand as well, the optional side bet for the purposes of the poker hand only is placed at step 120.

In either case, after the dealer has flopped his or her down card at step 140, a determination is made at step 150 for each player whether he or she won or lost at the Blackjack portion of the game. That determination will be made according to well-established rules as noted above In the event no player had placed a poker side bet at step 120, the game would be over and the dealer would settle all Blackjack bets at step 170.

However, in the event that one or more players had placed the optional poker bet at step 120, the dealer would then deal additional cards at step 180 as necessary to complete the poker hand for those players electing to play the poker hand. The basis for combining these games would be to turn an otherwise losing Blackjack hand into a potentially lucrative poker hand. Cards from the initial Blackjack hand would be retained by the players electing to play the poker hand, and used in conjunction with the additional cards dealt by the dealer at step 180. While each player would play against the dealer's cards in the Blackjack hand according to conventional rules, those players placing the optional side bet at step 140 to play the poker hand could either play against similarly dealt cards to the dealer or simply against the odds. In accordance with a presently preferred embodiment of this invention, the dealer does not participate in the poker hand, and each player's chance of success are measured only against the odds indicated below.

TABLE I

| Poker Hand | Odds |
|---|---|
| Royal Flush | 20,000:1 |
| Straight Flush | 2,000:1 |
| Four of a Kind | 300:1 |
| Full House | 30:1 |
| Flush | 15:1 |
| Straight | 6:1 |
| Three of a Kind | 4:1 |
| Two Pair | 2:1 |
| One Pair | 1:1 |

The dealer would then settle all poker bets at step 190 to complete the combined card game according to this first embodiment of the present invention. Players not achieving any of the above poker hands forfeit their poker side bets placed at step 120, and the game repeats. Of course, any variation of poker (e.g., five card stud, seven card stud, etc.) could be combined with the Blackjack game without departing from the spirit and scope of the present invention. The card game according to the present invention can also be played with from one to eight standard fifty-two card decks, or more as desirable.

Figure 3:
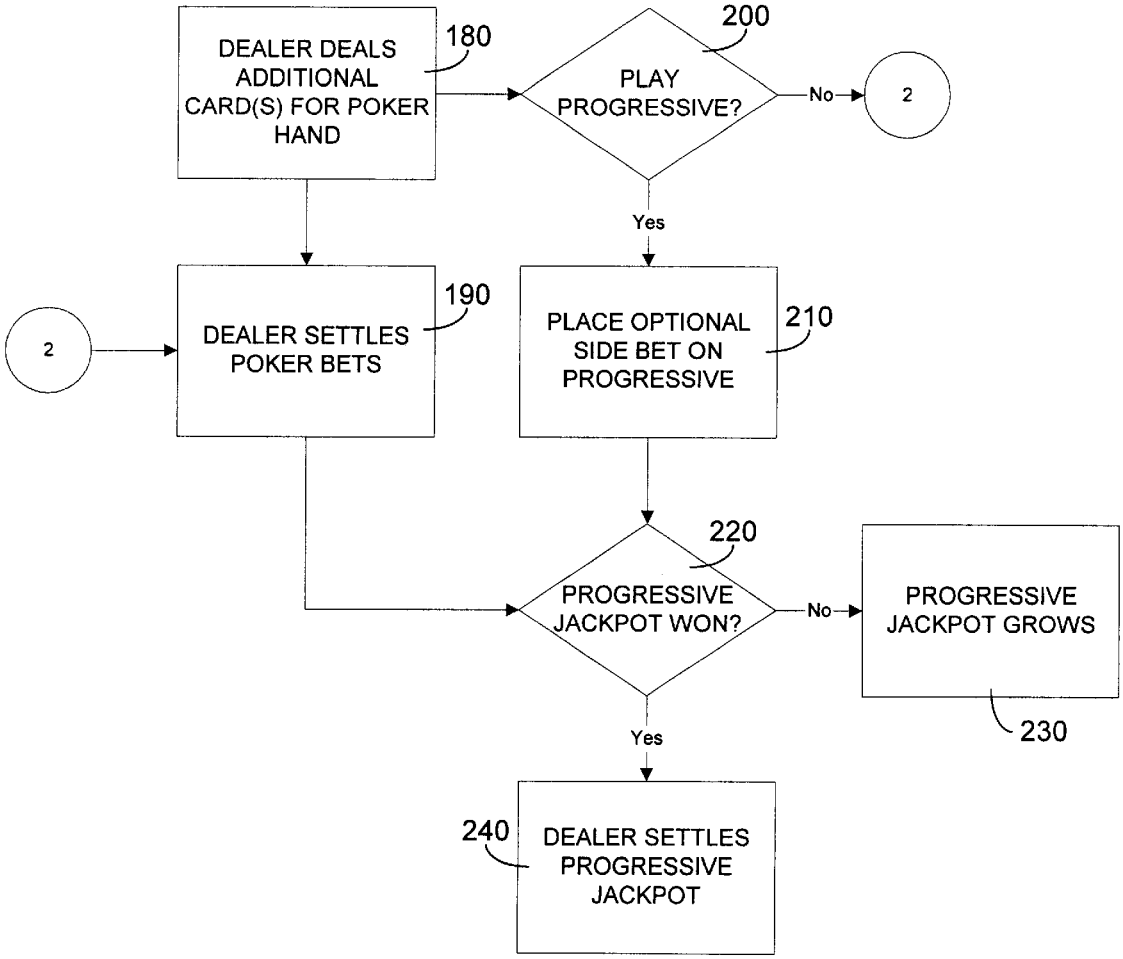
FIG. 3 is a flow chart illustrating a method of playing the card game according to another embodiment of the present invention.

Moreover, referring now to FIG. 3, the card game according to another embodiment of the present invention can include a progressive jackpot. A presently preferred embodiment of the instant invention requires all bets to be placed simultaneously at the outset of the game. Therefore, for players electing to play both Blackjack and poker, they would place both bets before the cards were dealt. In order to play the progressive part of this game, a player must elect to play both games and place a progressive bet (e.g., $1.00).

As seen in FIG. 3, the first eight steps of the combined card game according to FIG. 2 proceed, with the Blackjack hand played first, leading up to the dealer's dealing additional cards for the poker hand at step 180. Each player then decides whether or not he or she would like to play progressive at step 200. If no player chooses so, the game ends and the dealer settles all poker bets at step 190. On the other hand, if one or more players also desire to play for a progressive jackpot, an additional side bet on progressive only is placed at step 210, followed by a determination at step 220 whether a progressive jackpot has been won at step 220. If not, the players lose their side bets placed at step 210, and the progressive jackpot grows (as shown at step 230). Otherwise, if a progressive jackpot has been won, the dealer settles such progressive jackpot payoff(s) at step 240, and the game repeats.

The present invention, in addition to the live casino gaming table version of each of the embodiments described herein above, also contemplates video and/or electronic (e.g., via the Internet) versions of such embodiments. One suitable electronic video poker device of the general type suitable for use in the practice of the card game according to the present invention is disclosed in U.S. Pat. No. 4,948,134, the entire disclosure of which is incorporated by reference herein.

Obviously, many modifications and variations of the convertible gaming table 10 according to the present invention are possible when viewed in light of the foregoing teachings. For example, in the embodiment described with respect to FIG. 2, both blackjack and poker bets could be made at the same time, before the dealer flops down his or her card in step 130. Moreover, the progressive jackpot may be awarded as a lump-sum to a single winner only on achieving a significantly high poker hand (e.g., a royal flush). A fixed amount or a percentage of the progressive jackpot could alternatively be allocated to those players' achieving significantly high poker hands (e.g., three of a kind and up). Yet another alternative could be to award a variable payout super jackpot, which would award bonuses to players depending on the frequency with which such jackpots actually were awarded. It should be understood, therefore, that all such modifications and variations could be used in accordance with the present invention and would, thus, be deemed to fall within the scope of the appended claims.

What we claim as our invention is:

1. A method of playing a card game, comprising the steps of:

dealing a first hand, consisting of a first predetermined number of cards, to one or more players;

requiring said one or more players to each elect whether or not to play a second hand;

comparing each of said first hands to determine whether or not they constitute a winning first hand;

dealing a second hand, consisting of a second predetermined number of cards, to said players electing to do so, said second hand constituting a continuation of said first hand;

comparing each of said second hands using a predetermined ranking as a criterion for comparison to determine a winning second hand;

designating as a winner each player who had a winning first hand and/or a winning second hand; and paying each winner of the second hand in accordance with an odds table containing the predetermined ranking.

2. The method according to claim 1, wherein said first predetermined number of cards includes at least one face-up card.

3. The method according to claim 1, wherein said first predetermined number of cards consists of two cards.

4. The method according to claim 1, wherein said second predetermined number of cards are dealt face up.

5. The method according to claim 1, wherein said second predetermined number of cards consists of five cards.

6. The method according to claim 1, further comprising the step of requiring each player to place a bet before each step of dealing said first and second hands.

7. The method according to claim 1, wherein the first hand is a Blackjack hand.

8. The method according to claim 1, wherein the second hand is a poker hand, wherein the predetermined ranking is a poker ranking having poker ranks, and wherein the poker ranks have corresponding odds.

9. The method according to claim 8, wherein said step of paying each winner in accordance with the odds table containing the predetermined ranking includes comparing each second winning hand with the poker ranking in the odds table so that each second winning hand has a corresponding poker rank, and paying each winner of the second hand according to the odds corresponding to the poker ranks set forth in the following odds table:

| Poker Rank | Odds |
|---|---|
| Royal Flush | 20,000:1 |
| Straight Flush | 2,000:1 |
| Four of a Kind | 300:1 |
| Full House | 30:1 |
| Flush | 15:1 |
| Straight | 6:1 |
| Three of a Kind | 4:1 |
| Two Pair | 2:1 |
| One Pair | 1:1 |

10. The method according to claim 8, wherein said step of paying the winning player includes the step of paying the winning player a bonus amount depending upon the poker rank of the winning hand.

11. The method according to claim 8, including a jackpot component associated with said game and comprising the further steps of:

requiring each player wishing to participate in said jackpot component to place a wager separate and distinct from said bet prior to said step of dealing said hands;

designating as a jackpot winner each player participating in said jackpot whose completed selected hand comprises a predetermined arrangement of cards; and awarding a preselected portion of the jackpot to each jackpot winner.

12. The method according to claim 11, wherein said predetermined arrangement of cards and the preselected winning amount are as follows:

| Poker Rank | Amount |
|---|---|
| Royal Flush | 20,000:1 |
| Straight Flush | 2,000:1 |
| Four of a Kind | 300:1 |
| Full House | 30:1 |
| Flush | 15:1 |
| Straight | 6:1 |
| Three of a Kind | 4:1 |
| Two Pair | 2:1 |
| One Pair | 1:1 |

13. The method according to claim 11, wherein said preselected winning amount comprises a percentage of the current jackpot value.

14. The method according to claim 11, wherein said preselected winning amount comprises a fixed amount.

15. The method according to claim 1, wherein said card game is played on an electronic device and said cards comprise electronically produced visual representations of playing cards.

16. The method according to claim 15, wherein said one or more players are displaced remotely from the card game.

17. The method according to claim 16, wherein the card game is played over a network.

18. The method according to claim 17, wherein said network comprises the Internet.

19. The method according to claim 1, wherein said poker game is played in a live form on a gaming table with a human dealer and conventional playing cards.

* * * * *